US006494962B1

(12) United States Patent
Pavlock, Jr.

(10) Patent No.: US 6,494,962 B1
(45) Date of Patent: Dec. 17, 2002

(54) METHOD OF USING A DESICCANT FOR THE SUBSTANTIALLY COMPLETE ABSORPTION OF MOISTURE FROM A SPILL LOCATION

(76) Inventor: Bernard L. Pavlock, Jr., P.O. Box 5, Girard, OH (US) 44420

( * ) Notice: Subject to any disclaimer, the term of this patent is extended or adjusted under 35 U.S.C. 154(b) by 95 days.

(21) Appl. No.: 09/618,670

(22) Filed: Jul. 18, 2000

(51) Int. Cl.[7] ..... B08B 5/04; B08B 7/04
(52) U.S. Cl. ..... 134/6; 134/18; 134/21
(58) Field of Search ..... 134/6, 21, 18

(56) References Cited

U.S. PATENT DOCUMENTS 3,962,083 A * 6/1976 Goldman ..... 210/79
4,006,079 A * 2/1977 Langlois et al. ..... 210/36
5,688,305 A * 11/1997 Graeff ..... 95/14
5,830,281 A * 11/1998 Kliewer et al. ..... 134/6
6,143,390 A * 11/2000 Takamiya et al. ..... 428/90

* cited by examiner

*Primary Examiner*—Zeinab El-Arini
(74) *Attorney, Agent, or Firm*—Jeffrey D. Moy; Harry M. Weiss; Weiss, Moy & Harris, P.C.

(57) ABSTRACT

A method of using a desiccant for the absorption of moisture from a spill location. The method of using a desiccant for the absorption of moisture from a spill location comprises the steps of: identifying a spill perimeter of a liquid spill, removing standing liquid from within the spill perimeter, dispersing a layer of desiccant within the spill perimeter substantially covering the liquid spill, waiting a period of time until the desiccant is substantially saturated with moisture from the liquid spill, removing the moisture saturated desiccant, evaluating if moisture is still present at the spill location, and if moisture is still present, dispersing another layer of the desiccant within the spill perimeter substantially covering the liquid spill, waiting another period of time until the desiccant is substantially saturated with moisture from the liquid spill, removing the moisture saturated desiccant and repeating as necessary.

7 Claims, 1 Drawing Sheet

METHOD OF USING A DESICCANT FOR THE SUBSTANTIALLY COMPLETE ABSORPTION OF MOISTURE FROM A SPILL LOCATION

BACKGROUND OF THE INVENTION

1. Field of the Invention

This invention relates to the cleanup of spills, and more specifically, to a method of using a desiccant for the substantially complete absorption of moisture from a spill location.

2. Description of the Related Art

Fluid spills are an everyday occurrence throughout the home and work-place. Fluid spills may comprise water, paints, inks, lubricants, fuels, and other substances. Generally, the cleanup of fluid spills has involved the use of a mop and pail, a sponge, paper towels, a wet-dry vacuum, etc. to lift the fluid from the spill location. However, regardless of which of these means is used to attempt to remove all of the fluid, the spill location generally contains some moisture residue of the fluid. The moisture residue remains for a variety of reasons including: an inability to get the sponge or other cleanup means in contact with the moisture, or because the nature of the surface upon which the spill has occurred has a surface texture or construction that hinders the release of, or absorption by, the moisture to the cleanup means. Therefore, a need existed for a method of absorbing moisture from a spill location that would not be inhibited by surface texture or construction. An additional need existed for a method of absorbing moisture from a spill location that would leave the spill location substantially dry and free of moisture.

SUMMARY OF THE INVENTION

It is an object of the present invention to provide a method of absorbing moisture from a spill location that is not inhibited by surface texture or construction.

It is another object of the present invention to provide a method of absorbing moisture from a spill location that leaves the spill location substantially dry and free of moisture.

The foregoing and other objects, features, and advantages of the invention will be apparent from the following, more particular, description of the preferred embodiment of the invention, as illustrated in the accompanying drawings.

BRIEF DESCRIPTION OF THE PREFERRED EMBODIMENTS

According to one aspect of the invention, a method of using a desiccant for the absorption of moisture from a spill location is disclosed. The method of using a desiccant for the absorption of moisture from a spill location comprises the steps of: identifying a spill perimeter of a liquid spill, removing standing liquid from within the spill perimeter, dispersing a layer of desiccant within the spill perimeter substantially covering the liquid spill, waiting a period of time until the desiccant is substantially saturated with moisture from the liquid spill, and removing the moisture saturated desiccant.

According to another aspect of the invention, a method of using a desiccant for the absorption of moisture from a spill location is disclosed. The method of using a desiccant for the absorption of moisture from a spill location comprises the steps of: identifying a spill perimeter of a liquid spill, removing standing liquid from within the spill perimeter, dispersing a layer of desiccant within the spill perimeter substantially covering the liquid spill, waiting a period of time until the desiccant is substantially saturated with moisture from the liquid spill, removing the moisture saturated desiccant, evaluating if moisture is still present at the spill location, and if moisture is still present, dispersing another layer of the desiccant within the spill perimeter substantially covering the liquid spill, waiting a period of time until the desiccant is substantially saturated with moisture from the liquid spill, and removing the moisture saturated desiccant.

According to a further aspect of the invention, a method of using a desiccant for the absorption of moisture from a spill location is disclosed: The method of using a desiccant for the absorption of moisture from a spill location comprises the steps of: identifying a spill perimeter of a liquid spill; removing standing liquid from within the spill perimeter; dispersing a layer of desiccant within the spill perimeter substantially covering the liquid spill; waiting a period of time until the desiccant is substantially saturated with moisture from the liquid spill; removing the moisture saturated desiccant; evaluating if moisture is still present at the spill location, and if moisture is still present, dispersing another layer of the desiccant within the spill perimeter substantially covering the liquid spill; waiting a period of time until the desiccant is substantially saturated with moisture from the liquid spill; removing the moisture saturated desiccant; and repeating the following steps until moisture is no longer present as indicated by the desiccant remaining substantially dry following dispersal within the spill perimeter: dispersing a layer of desiccant within the spill perimeter substantially covering the liquid spill, waiting a period of time until the desiccant is substantially saturated with moisture from the liquid spill, and removing the moisture saturated desiccant.

DESCRIPTION OF THE PREFERRED EMBODIMENTS

Figure 1:
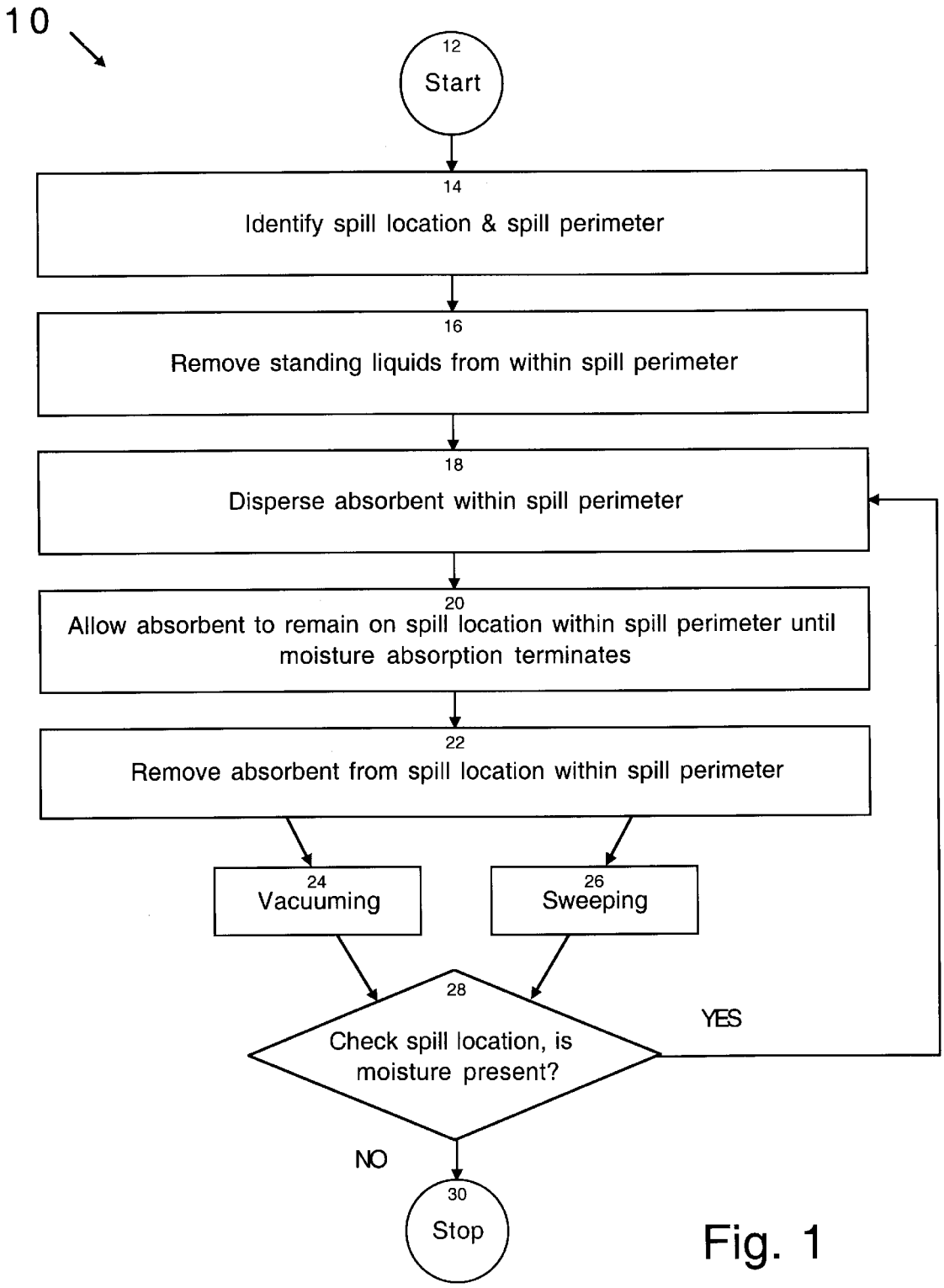
FIG. 1 is a flowchart showing the steps of the present invention, a method of using a desiccant for the substantially complete absorption of moisture from a spill location.

Referring to FIG. 1, a flowchart shows the steps of the method of using a desiccant for the substantially complete absorption of moisture from a spill location (the "method 10" hereinafter). The method 10 is useful for the substantially complete absorption of moisture from a spill location, particularly when the location or the location construction inhibits the removal of moisture. The present invention uses a desiccant, which is generally comprised of silica gel in a powder, or sand-like form. One source for silica gel is the Eagle Chemical Company of Mobil Ala., although other sources of silica gel and equivalent substances are readily located by those skilled in the art. When attending to a spill of fluids, in which an object is to quickly effect the drying of the spill location, a desiccant will result in the substantially complete removal of all moisture in a short period of time. This substantially complete removal of moisture occurs because the desiccant's affinity for moisture causes the transference of the moisture from the surface of, or in, the spill location into the desiccant substance thus leaving a dry location behind. In contrast, other methods of cleaning up a spill location use towels, mops, etc. all of which leave a large amount of moisture, and even standing liquids remaining. Some situations for which the method 10 of the present invention are well suited comprise: liquid spills on floors and carpets, wet clothing such as gloves, shoes, boots, snow gear, camping gear, etc. Additional applications comprise spills of liquids on sensitive equipment such as keyboards, spills on delicate surfaces that must be quickly returned to a dry state such as paintings, pool table felt, etc.

A preferred embodiment of the method 10 comprises the following steps: Identifying a spill location and spill perimeter 14. This step ensures that substantially all moisture containing areas will in fact be located and thus the moisture present will be absorbed by the desiccant. The next step is to remove standing liquids from within the spill perimeter 16. The removal of standing liquids is an issue of efficiency as it allows the more efficient use of the absorbent desiccant on hand. However, it is possible to bypass this step and proceed directly to the next step although larger quantities of absorbent desiccant will be required. The next step comprises the dispersal of the absorbent desiccant within the spill perimeter 18. The absorbent desiccant must be dispersed to substantially cover all moisture locations within the spill perimeter. The next step is to wait a period of time until the absorbent desiccant is substantially saturated with moisture from the liquid spill and the moisture absorption terminates 20. This termination of moisture absorption by the absorbent desiccant may be determined by visual observation of the surface of the absorbent desiccant. When moisture absorption is substantially complete, either due to the substantially complete absorption of moisture, or the saturation of the absorbent desiccant, the appearance of the surface of the layer of absorbent desiccant will cease changing.

The next step is the removal of the absorbent desiccant from within the spill perimeter 22. The removal of the absorbent desiccant may be accomplished by a variety of means including sweeping 26, or more efficiently, by vacuuming 24.

The next step comprises evaluating if moisture is still present at the spill location 28. If moisture is still present, the method 10 is repeated starting with the step of dispersing another layer of the absorbent desiccant within the spill perimeter substantially covering the liquid spill 18. This repeated step of the dispersal of absorbent desiccant is followed by the further steps of: waiting a period of time until the absorbent desiccant is substantially saturated with moisture from the liquid spill 20; removing the moisture saturated absorbent desiccant 22; and again evaluating if moisture is still present at the spill location 28. These steps of the method 10 are repeated until moisture is no longer present within the spill perimeter 28.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A method of using a desiccant for the absorption of moisture from a spill location comprising the steps of:

identifying a spill perimeter of a liquid spill;

removing standing liquid from within said spill perimeter;

dispersing a desiccant layer of silica gel within said spill perimeter substantially covering said liquid spill;

waiting a period of time until said desiccant is substantially saturated with moisture from said liquid spill;

removing said moisture saturated desiccant;

evaluating if moisture is still present at said spill location, and if moisture is still present, dispensing another layer of said desiccant within said spill perimeter substanitally covering said liquid spill;

waiting a period of time until said another layer of said desiccant is substantially saturated with moisture from said liquid spill if said another layer of said desiccant is require;

removing said another layer of said desiccant after said another layer of said desiccant is saturated with said liquid spill if said another layer of said desiccant is require;

evaluating if moisture is still present at said spill location, and if moisture is still present, dispensing a third layer of said desiccant within said spill perimeter substanitally covering said liquid spill;

waiting a period of time until said third layer of said desiccant is substantially saturated with moisture from said liquid spill if said third layer of said desiccant is require;

removing said third layer of said desiccant after said third layer of said desiccant is saturated with said liquid spill if said third layer of said desiccant is require; and repeating the steps of evaluating if moisture is still present at said spill location, waiting a period of time until said another layer of said desiccant is substantially saturated, and removing said another layer of said desiccant until moisture from said liquid spill is no longer present;

wherein said steps of removing said layers of said desiccant which are saturated comprises the step of using a vacuum to remove said layers of said moisture saturated desiccant.

2. The method of claim 1 wherein the step of removing said moisture saturated desiccant comprises the step of sweeping to remove said moisture saturated desiccant.

3. The method of claim 1 wherein the step of removing said moisture saturated desiccant comprises the step of using a vacuum to remove said moisture saturated desiccant.

4. The method of claim 1 wherein the step of removing said moisture saturated desiccant comprises the step of sweeping to remove said moisture saturated desiccant.

5. A method of using a desiccant for the absorption of moisture from a spill location comprising the steps of:

identifying a spill perimeter of a liquid spill;

removing standing liquid from within said spill perimeter;

dispersing a desiccant layer of silica gel within said spill perimeter substantially covering said liquid spill;

waiting a period of time until said desiccant is substantially saturated with moisture from said liquid spill;

removing said moisture saturated desiccant;

evaluating if moisture is still present at said spill location, and if moisture is still present, dispersing another layer of said desiccant within said spill perimeter substantially covering said liquid spill;

waiting a period of time until said desiccant is substantially saturated with moisture from said liquid spill; and removing said moisture saturated desiccant;

repeating the following steps until moisture is no longer present as indicated by said desiccant remaining substantially dry following dispersing within said spill perimeter:

dispersing a layer of desiccant within said spill perimeter substantially covering said liquid spill;

waiting a period of time until said desiccant is substantially saturated with moisture from said liquid spill; and removing said moisture saturated desiccant;

wherein the steps of removing said moisture saturated desiccant comprises the step of using a vacuum to remove said moisture saturated desiccant.

6. The method of claim 5 further comprising the step of repeating the following steps until moisture is no longer present as indicated by said desiccant remaining substantially dry following dispersing within said spill perimeter:

dispersing a layer of desiccant within said spill perimeter substantially covering said liquid spill;

waiting a period of time until said desiccant is substantially saturated with moisture from said liquid spill; and removing said moisture saturated desiccant.

7. The method of claim 6 wherein the step of removing said moisture saturated desiccant comprises the step of using a vacuum to remove said moisture saturated desiccant.

* * * * *